US009447686B2

(12) United States Patent
Krebs

(10) Patent No.: US 9,447,686 B2
(45) Date of Patent: Sep. 20, 2016

(54) AXIAL PISTON MACHINE HAVING AN INSERT RING AND AN INSERT RING FOR AN AXIAL PISTON MACHINE

(75) Inventor: Clemens Krebs, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 337 days.

(21) Appl. No.: 13/703,948

(22) PCT Filed: Jun. 22, 2011

(86) PCT No.: PCT/EP2011/060475
§ 371 (c)(1),
(2), (4) Date: Feb. 28, 2013

(87) PCT Pub. No.: WO2011/161178
PCT Pub. Date: Dec. 29, 2011

(65) Prior Publication Data

US 2013/0199363 A1 Aug. 8, 2013

(30) Foreign Application Priority Data

Jun. 23, 2010 (DE) ..... 10 2010 024 801

(51) Int. Cl.
*F01B 3/00* (2006.01)
*F04B 1/20* (2006.01)
(Continued)

(52) U.S. Cl.
CPC ..... *F01B 3/0044* (2013.01); *F04B 1/2014* (2013.01); *F04B 1/2028* (2013.01); *F04B 1/2064* (2013.01); *F04B 23/06* (2013.01); *F04B 53/16* (2013.01); *F05C 2201/0439* (2013.01); *F05C 2201/0442* (2013.01); *F05C 2201/0448* (2013.01); *F05C 2201/0451* (2013.01)

(58) Field of Classification Search
CPC .... F04B 1/122; F04B 1/2057; F04B 1/2021; F04B 1/2014; F04B 1/2028; F04B 1/2064; F01B 3/0044
USPC ..... 417/269, 531, 203, 205; 91/499; 92/12.2, 57, 71
See application file for complete search history.

(56) References Cited

U.S. PATENT DOCUMENTS 2,292,294 A * 8/1942 Rotter et al. ..... 137/469
4,030,405 A * 6/1977 Aldinger et al. ..... 92/58
(Continued)

FOREIGN PATENT DOCUMENTS

DE 195 36 997 C1 2/1997
DE 19536997 C1 * 2/1997
DE 10 2005 033 104 A1 1/2007
(Continued)

OTHER PUBLICATIONS

U.S. Appl. No. 13/703,948, filed Jan. 8, 2015, DE_19536997_C1_I with Translation pages, Hoffmeister, Feb. 2, 1997.*
(Continued)

*Primary Examiner* — Devon Kramer
*Assistant Examiner* — Kenneth J Hansen
(74) *Attorney, Agent, or Firm* — Maginot, Moore & Beck LLP

(57) ABSTRACT

An axial piston machine includes a housing having a casting which is optimized with respect to casting. An insert ring which is optimized with respect to a pressure load is formed in the bottom of the housing. The insert ring is configured to be used with such an axial piston machine.

13 Claims, 7 Drawing Sheets

(51) Int. Cl.
*F04B 23/06* (2006.01)
*F04B 53/16* (2006.01)

(56) References Cited

U.S. PATENT DOCUMENTS 5,598,761 A * 2/1997 Kristensen et al. ..... 92/57
5,681,149 A 10/1997 Weatherly

FOREIGN PATENT DOCUMENTS

DE 10 2006 062 065 A1 7/2008
GB 2 269 208 A 2/1994

OTHER PUBLICATIONS

International Search Report corresponding to PCT Application No. PCT/EP2011/060475, mailed Sep. 30, 2011 (German and English language document) (7 pages).

* cited by examiner

AXIAL PISTON MACHINE HAVING AN INSERT RING AND AN INSERT RING FOR AN AXIAL PISTON MACHINE

This application is a 35 U.S.C. §371 National Stage Application of PCT/EP2011/060475, filed on Jun. 22, 2011, which claims the benefit of priority to Serial No. DE 10 2010 024 801.0, filed on Jun. 23, 2010 in Germany, the disclosures of which are incorporated herein by reference in their entirety.

The disclosure relates to an axial piston machine in accordance with the description below and to an insert ring suitable for an axial piston machine of this kind.

BACKGROUND

An axial piston machine of this kind is known from DE 10 2006 062 065 A1 and from Bosch Rexroth AG data sheet RDE 93220-04-R/02.08, for example, and can be embodied as a single or dual axial piston machine, for example. In these known solutions, the axial piston machine is embodied with a housing in which at least one cylinder barrel having a multiplicity of pistons, each delimiting a working space, is rotatably mounted. These pistons are each supported by means of a piston foot on a swashplate, the angle of incidence of which determines the piston stroke.

The respective working space delimited by a piston can be connected alternately to a high-pressure and low-pressure duct by means of a control disk arranged at the end in the housing. The cylinder barrel is connected for conjoint rotation to a drive shaft, which acts either as an output shaft or as an input shaft, depending on the type of machine (motor, pump).

In the known solutions, the housing of the axial piston machine is of approximately cup-shaped design, wherein the high-pressure and low-pressure ducts are formed in a bottom of the cup-shaped housing and can be connected successively to the working spaces of the cylinder barrel by means of the control disk, which is fixed in relation to the rotating cylinder barrel. Formed in this control disk is a plurality of comparatively small kidney-shaped delivery openings, which lie on a common pitch circle and between which respective pressure lands are formed. On the low-pressure side, each control disk is embodied with a kidney-shaped intake opening, which extends over a larger circumferential angular range than the small kidney-shaped delivery openings.

In the region of the kidney-shaped delivery openings and of the pressure lands adjoining said openings, the high-pressure ducts are supplied with comparatively high pressures during the operation of the axial piston machine. The problem with this is that the cup-shaped housing is generally produced from spheroidal graphite iron and that, in the transition zone from the circumferential wall of the housing to the bottom region, there is a zone which is problematic in respect of the profile of the casting front, in which shrinkage cavities can occur as the casting solidifies. At high loads due to a high hydraulic pressure, damage or deformation of the housing may then occur in the region of said shrinkage cavities, thus reducing the life of the axial piston machine. These problems are more severe in the case of dual axial piston machines since the problems with casting are even more difficult to overcome, owing to the housing in the form of a dual cup.

DE 195 36 997 C1 shows a dual axial piston pump of swashplate construction in which the actual pump housing is embodied with an approximately disk-shaped central part in which the two drive shafts of the unit are connected to one another for conjoint rotation. Also mounted in this region is an impeller of a boost pump, by means of which the pressure medium can be subjected to a boost pressure on the low-pressure side. For the mounting of this impeller, the central part is embodied with an insert, which is inserted into the central part once the impeller has been mounted. High-pressure and low-pressure duct sections of a pump unit, which are assigned to one of the cylinder barrels, are formed in this insert. In the case of the second pump unit, these high-pressure and low-pressure duct sections are formed in the wall of the central part, and therefore the same problems can occur in this region as with the prior art described at the outset.

A corresponding dual axial piston pump is also described in Bosch Rexroth AG data sheet RDE 93220-04-R/02.08.

Given this situation, it is the underlying object of the disclosure to provide an axial piston machine in which the risk of damage due to pressure is reduced.

This object is achieved by an axial piston machine having the features described below. The disclosure is furthermore achieved by an insert ring in accordance with additional description below.

Advantageous developments of the disclosure form the subject matter of the below description.

SUMMARY

The axial piston machine according to the disclosure is embodied with a housing, in which a cylinder barrel having a multiplicity of pistons, each delimiting a working space, is rotatably mounted. Said pistons are supported by means of piston feet on a swashplate. The working spaces delimited by the pistons can be connected alternately to a low-pressure and a high-pressure duct by means of a control disk arranged at the end in the housing. In the axial piston machine, the cylinder barrel is connected for conjoint rotation to a drive shaft. According to the disclosure, the housing is of approximately cup-shaped design with a cup bottom, through which the drive shaft passes, said bottom being formed in sections by an insert ring. Said insert ring has a multiple function since, on the one hand, it serves to support the drive shaft and, on the other hand, has a high-pressure duct section, which has an axial orifice region on the control-disk side and a radial or axial orifice region on the high-pressure duct side. In this case, the material, design and production method for the insert ring are optimized in respect of the pressure loading.

The insert ring according to the disclosure is designed accordingly.

According to the concept according to the disclosure, the housing thus no longer determines the pressure resistance of the pump, since the highly loaded regions around the high-pressure connection are formed in the insert ring of optimized material, which is much easier to manage in terms of casting technique. This construction makes it possible to embody the housing with a comparatively thin wall, while the housing bottom is formed by the insert ring in the region of the zones subject to pressure loading. In this way, the housing, in particular the core of the casting mold, by means of which the interior space of the housing is formed, can be optimized in terms of casting, and the overall volume, in particular the overall length, of the unit as a whole can be shortened as compared with conventional solutions since these require very large-volume housings in order to provide the required pressure resistance.

Moreover, the housing according to the disclosure can be produced with considerably lower outlay on manufacture owing to its simple construction.

The reduced outlay on manufacture is the result, in particular, of the fact that the core that forms the interior space of the housing can be made significantly more massive than in the prior art. Moreover, the housing can be embodied with smaller accumulations of material and thus lower stresses in the casting process, owing to the insert ring.

In a variant, the insert ring is inserted into a socket in the housing, wherein the diameter of the socket and hence the outside diameter of the insert ring is significantly larger than the outside diameter of the drive shaft. The unfinished housing part is then pierced in the region of the cup bottom with a large diameter, thus enabling the casting core which forms the housing cavity to be made very robust and not susceptible to deformation or breakage during casting. Moreover, an accumulation of material in the difficult solidification region and the associated problems are avoided.

For the purpose of axial guidance and axial force absorption, said socket can be embodied with a stepped bore which accommodates an encircling shoulder of the insert ring.

In principle, it is also possible, instead of the spheroidal graphite iron which is usually used, to produce the housing from some other material, e.g. light alloy or gray cast iron.

In one embodiment of the disclosure, the insert ring is embodied as a casting, with the tried and tested spheroidal graphite iron preferably being used. As an alternative, nitrided cast steel can be used for production. The insert ring can also be produced as a forging or from a solid part by machining. In the case of high pressure loads, for example, it is thus possible for the insert ring to be produced from steel (forged or solid material), in which case the ducts are formed by machining.

In a particularly compact solution, a low-pressure duct section having a radial and an axial or radial orifice region is also formed in the insert ring.

The construction of the axial piston machine can be simplified if a mating surface for a pressure bushing inserted into the housing is formed on the orifice region on the high-pressure side.

In a variant of the disclosure, a pressure bushing is designed as a stepped bushing, with a pressure force resultant pushing the pressure bushing inward in the direction of the mating surface.

In a variant of this kind, it is particularly advantageous if the pressure bushing acts as a position securing means for the insert ring in respect of an angular position.

The axial piston machine can be made adjustable.

According to the disclosure, it is preferred if the insert ring has a socket for a shaft bearing of the drive shaft.

In one embodiment of the disclosure, the axial piston machine is embodied with a boost pump, by means of which the pressure medium flowing in on the low-pressure side can be subjected to a boost pressure.

An impeller wheel of a boost pump can be guided on the drive shaft and taken along by the latter.

One variant of the disclosure envisages that the impeller wheel forms a sealing gap, at least in a section or sections, with at least one insert ring.

In one embodiment of the disclosure, the axial piston machine is embodied as a dual axial piston machine, wherein two cylinder barrels with mutually facing ends are formed in a common housing, wherein each of these ends is embodied with an insert ring in the sense of the explanations given above.

A boost pump, by means of which the pressure medium on the low-pressure side can be subjected to a boost pressure, can be arranged in the region between the cylinder barrels. The embodiment of an axial piston machine with a boost pump is advantageous especially at high speeds of rotation, even in the case of a single axial piston machine.

In the case of a dual axial piston machine, each cylinder can be assigned a drive shaft, which are connected to one another by a coupling bush.

The insert ring according to the disclosure has a high-pressure duct section, which has an end orifice region and an axial or radial orifice region. Moreover, said insert ring is optimized for the pressure conditions in terms of the production method, design or selection of materials and is preferably made of spheroidal graphite iron. In principle, a high-strength and ductile special casting material can be used. As explained above, the insert ring can also be embodied as a forging or can be produced from a solid part by machining.

The pressure resistance of the insert ring can be increased by appropriate heat treatment, e.g. by hardening and tempering, nitriding or gas hydrocarbonation.

BRIEF DESCRIPTION OF THE DRAWINGS

Preferred embodiments of the disclosure description are explained in greater detail below with reference to schematic drawings, in which.

DETAILED DESCRIPTION

Figure 1:
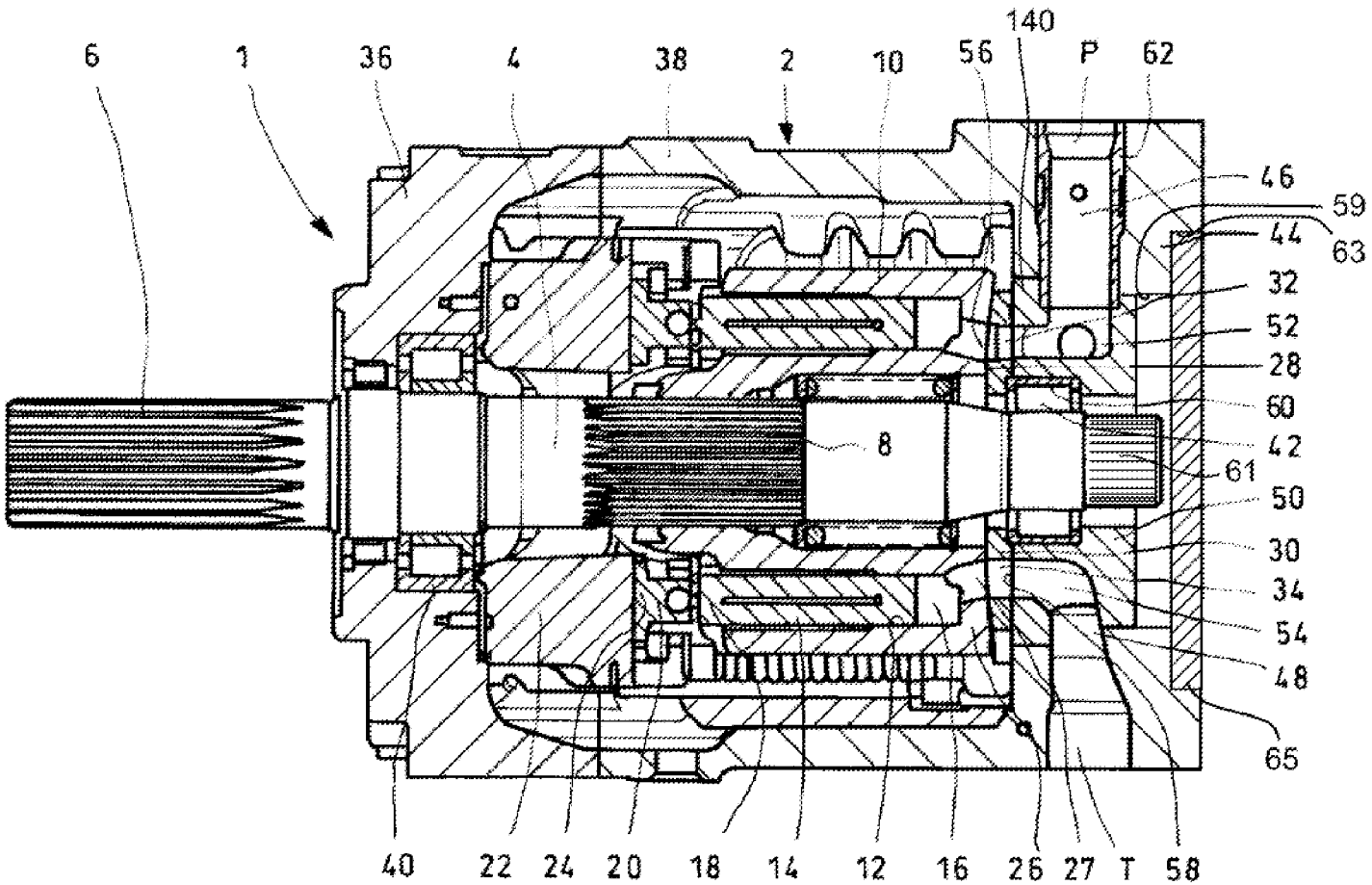
FIG. 1 shows a longitudinal section through a single axial piston machine.

The disclosure is explained below with reference to two embodiments, with FIG. 1 showing a single axial piston pump and FIGS. 2 to 8 showing a dual axial piston machine. Since the basic construction of axial piston machines of this kind is sufficiently well known from the prior art, only those components which are essential for understanding the disclosure are explained below.

The single axial piston pump 1 according to FIG. 1 has a pump housing 2, in which a drive shaft 4 is mounted, the left-hand end section of which in FIG. 1 projects from the pump housing 2 and is provided with external splines 6, via which a drive can be coupled. In the central area, the drive shaft 4 has additional external splines 8, which mesh with corresponding internal splines on a cylinder barrel 10. This has a multiplicity of cylinder bores 12 lying on a common pitch circle, in each of which a piston 14 is guided. Together with the cylinder bore 12, said piston delimits a working space 16, the volume of which is dependent on the piston stroke. A piston foot 18 of each piston 14, said piston foot being remote from the working space 16, is connected in an articulated manner to a sliding shoe 20. Said shoe rests against a swashplate 22 mounted in the pump housing 2 in a manner which prevents relative rotation, wherein the angle of incidence of a contact surface 24, on which the sliding shoes 20 slide, determines the piston stroke. Depending on the configuration of the axial piston machine, this angle of incidence can be of adjustable or invariable design.

On its right-hand end face in FIG. 1, the cylinder barrel has an end wall 26, in which a multiplicity of ducts 27 lying on a common pitch circle are formed, said ducts opening, on the one hand, into the working space 16 and, on the other hand, into the external end face 28 of the end wall 26. This is of concavely spherical design and rests in a sliding manner on a control disk 30 mounted in a manner fixed relative to the housing, in which disk kidney-shaped delivery openings 32 and a comparatively large kidney-shaped intake opening 34 are formed in a manner known per se. The fundamental construction of such kidney-shaped openings is explained below with reference to FIGS. 5 to 8.

The pump housing 2 is of multi-part design and has an end cover 36, which is mounted on an approximately cup-shaped housing 38. The drive shaft 4 is mounted in the pump housing 2 by means of rolling contact bearings, wherein one rolling contact bearing 40 is accommodated in the region of the cover 36 and another rolling contact bearing or rolling contact bearing assembly 42 is accommodated in the housing 38. The cup-shaped housing 38 has a cup bottom 44, which forms the end termination of the pump housing 2 toward the right in FIG. 1. In the embodiment shown, a delivery port P and an intake port T are formed radially in said cup bottom 44, said ports being connected by a delivery duct 46 and an intake duct 48, respectively, to the above-mentioned kidney-shaped delivery openings 32 and the kidney-shaped intake opening 34.

According to the disclosure, an insert ring 50 is inserted into the cup bottom 44, said ring being made of a comparatively high-strength material, e.g. from spheroidal graphite iron with an additional heat treatment, while the housing 38 can be produced from a material with a comparatively low pressure resistance, e.g. from gray cast iron or light metal casting alloy or the like. A high-pressure duct section 52 and a low-pressure duct section 54 are formed in the insert ring 50, each of said sections being embodied as an angled duct. In this arrangement, axial orifice regions 56 and 58 overlap with the kidney-shaped delivery openings 32 and the kidney-shaped intake opening 34, respectively. An orifice region which opens in the radial direction then opens into the respectively adjacent delivery duct 46 or intake duct 48.

The insert ring 50, which is explained in greater detail below, is inserted into a socket in the cup bottom 44, which is designed as a stepped bore 59. Said bore is widened in the radial direction to the left in the illustration in FIG. 1, with the result that a radially projecting shoulder 140 of the insert ring 50 (see also FIG. 5) is supported in the axial direction on a shoulder of the stepped bore 59. Radial guidance is provided along the outer circumferential surface 170 (see FIG. 6) of the shoulder 140 and the outer circumferential surface of an annular section 142 of the insert ring 50 (said annular section being explained in greater detail with reference to FIGS. 5 and 6), which are supported in the radial direction on the circumferential surfaces of the stepped bore 59.

As can furthermore be seen from FIG. 1, an end section of the drive shaft 4 which passes through the insert ring 50 is embodied with shaft splines 61, thus allowing a through-drive option, e.g. for a dual pump. In the embodiment shown in FIG. 1, the stepped bore 59 of the cup bottom 44 also widens to the right, thus forming a socket 63 for a closure cap 65, which closes off the cup bottom 44 at the end. This cap is removed in embodiments with a through-drive option.

As can be seen from FIG. 1, the inside diameter of the stepped bore 59 and the outside diameter of the correspondingly stepped insert ring 50 is significantly larger than the diameter of the drive shaft 4, with the result that a comparatively large opening is formed in the cup bottom 44, said opening being significantly easier to manage in terms of casting since, on the one hand, the core can be made more massive and, on the other hand, accumulations of material of the kind that occur in the prior art are avoided.

According to the illustration in FIG. 1, the rolling contact bearing 42 is inserted into a mounting space 60 in the insert ring 50, with axial support also being provided by means of the control disk 30, with the result that the rolling contact bearing 42 is fixed in the axial direction by the insert ring 50 and the control disk 30. Further details of this insert ring 50 are explained below.

A pressure bushing 62 is inserted into the delivery duct 46 in the region of the delivery port P. As will be explained in greater detail below with reference to FIG. 4, said pressure bushing 62 is of stepped design and is subjected to high pressure or housing pressure in such a way that a pressure force resultant that acts radially inward is formed. The end section of the pressure bushing which is at the bottom in FIG. 1 rests with an accurate fit on a mating surface of the insert ring 50, with the result that the latter is fixed in position by means of the pressure bushing 62. Further details of the pressure bushing 62 are explained below with reference to FIG. 4.

As already mentioned, the pump housing 2 or, to be more precise, the cup-shaped housing 38 is subjected to considerable pressure forces during the operation of the axial piston pump, especially in that region of the cup bottom 44 which adjoins the control disk 30. According to the disclosure, said forces are absorbed by the insert ring 50, which is matched to said pressure loading in terms of its geometry and the choice of material. This enables the cup-shaped housing 38 to be of comparatively simple construction, which is easy to manage in terms of casting.

In the embodiment of a dual axial piston machine which is described below, this concept is correspondingly adopted. In principle, the unit shown in FIG. 1 is duplicated in a dual axial piston machine of this kind about an axis of symmetry situated in the region of the cup bottom, so that, as shown in the longitudinal section in FIG. 2, a central housing 38 is obtained (for the sake of simplicity, the same reference signs are used below for corresponding components), said housing having a central part 64, in which two delivery ports P1, P2 and two tank ports T1, T2 (indicated by dashed lines in this illustration) are formed in a corresponding manner, each being assigned to one unit 66, 68 of the dual axial piston pump 1.

The housing 38 of this dual unit is then correspondingly of "double cup-shaped" design, wherein the central part 64 forms the cup bottom 44 of both units 66, 68. Respective cylindrical housing walls 70, 72 are attached to said central part 64, said housing walls, together with the covers 36, 74 situated on the outside, forming a mounting space for the cylinder barrels 10, 76 of the unit 66, 68.

The basic construction of each of these units 66, 68 corresponds in principle to that of the single axial piston machine described at the outset, and therefore detailed explanations are unnecessary if reference is made to the statements made in this regard.

Accordingly, each unit 66, 68 has a drive shaft 4 and 78, respectively, wherein the drive shaft 78 assigned to the second unit 68 does not protrude from the cover 74 but is connected for conjoint rotation to the drive shaft 4 by means of a coupling bush 80, which will be explained in greater detail below.

As described, for example, in DE 195 36 997 C1, dual axial piston machines of this kind can be embodied with a boost pump 82. In this specific solution, said boost pump 82 is formed by an impeller, which is connected for conjoint rotation to the drive shaft 4 and by means of which the insert rings 50, 86 are subjected to a boost pressure on the intake side. In the solution shown, an impeller wheel 84 is guided and supported axially on the drive shaft 4 and is sealed off with respect to the respective insert ring 50, 86 with a minimum gap. Further details of this arrangement are explained with reference to the following figures.

Figure 2:
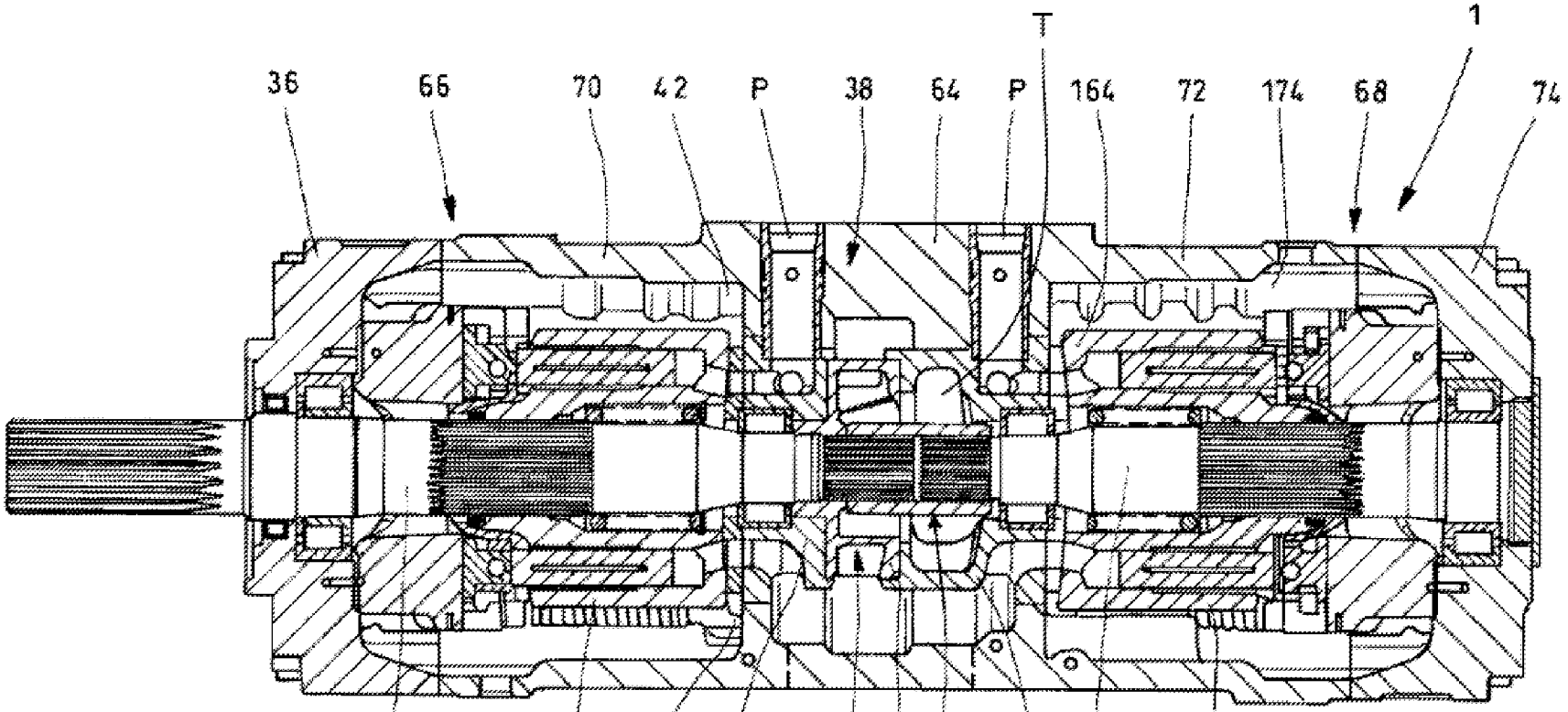
FIG. 2 shows a longitudinal section through a dual axial piston machine.
Figure 3:
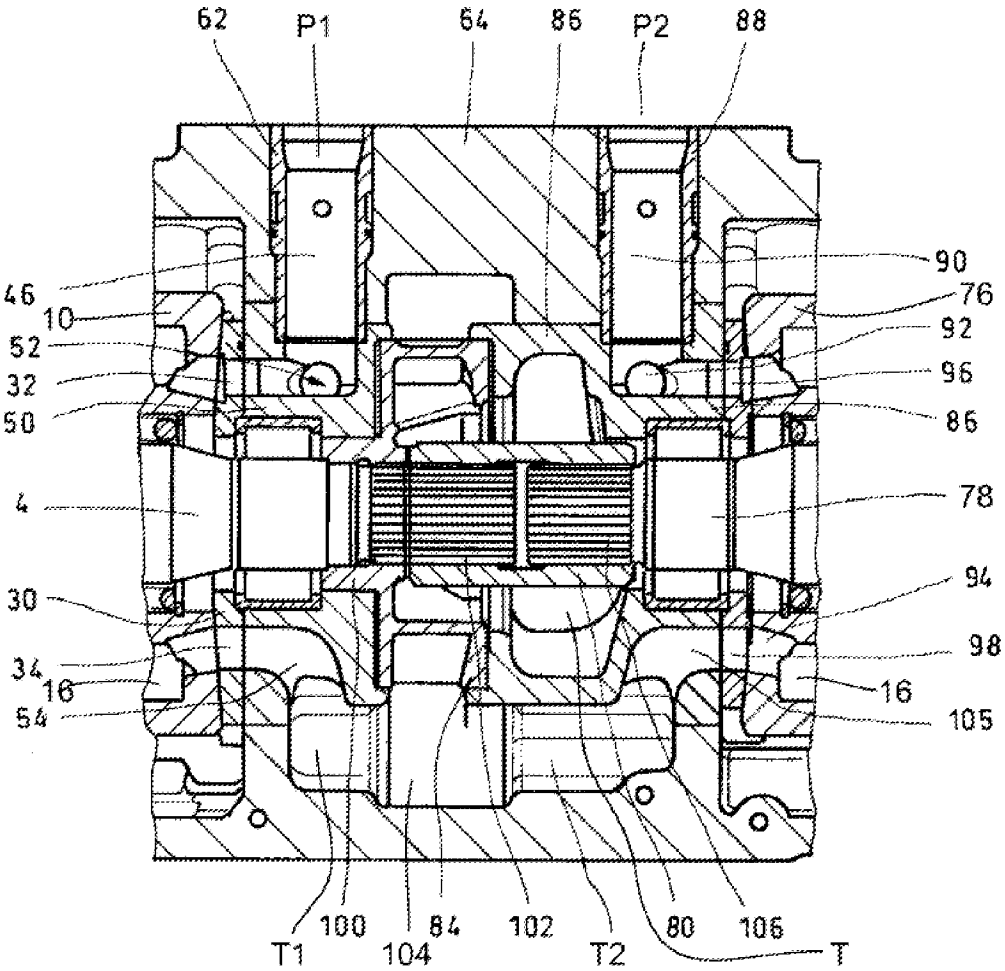
FIG. 3 shows a detail of the axial piston machine from FIG. 2.

FIG. 3 shows an enlarged illustration of the central part 64 of the dual axial piston machine 1 shown in FIG. 2. It will be seen that respective pressure bushings 62, 88 are inserted in the region of the two delivery ports P1, P2, each of said bushings serving as an axial retention means for the associated insert ring 50, 86. As in the embodiment described at the outset, the high-pressure flow path for the pressure medium is formed by a delivery duct 46, 90. These merge respectively into high-pressure duct sections 52 and 92 of insert ring 50 and insert ring 86. Respective control disks 30, 94, in which kidney-shaped delivery openings 32, 96 and the kidney-shaped intake opening 34, 98 are formed, rest against the ends of these two insert rings 50, 86.

As explained at the outset, the kidney-shaped delivery openings 32, 96 and the kidney-shaped intake openings 34, 98 are alternately in pressure-medium communication with the working spaces 16 during the rotation of the cylinder barrels 10, 76.

In the illustration according to FIG. 3, the impeller wheel 84, which is mounted on the drive shaft 4 by means of an axially projecting hub 100, can be clearly seen, wherein internal splines are formed in the hub 100, meshing with external splines 102 formed on the end section of the drive shaft 4. By means of the impeller wheel 84, pressure medium is drawn out of an intake space T and pumped into a boost pressure space 104. The boost pressure space 104, which is connected to ports T1 and T2, is connected via intake-side low-pressure duct sections 54, 105 to the kidney-shaped intake openings 34, 98.

As already mentioned, the two drive shafts 4, 76 are connected for conjoint rotation by a coupling bush 80, which meshes, on the one hand, with the external splines 102 of the drive shaft 4 and, on the other hand, to corresponding external splines 106 on the drive shaft 78.

Figure 4:
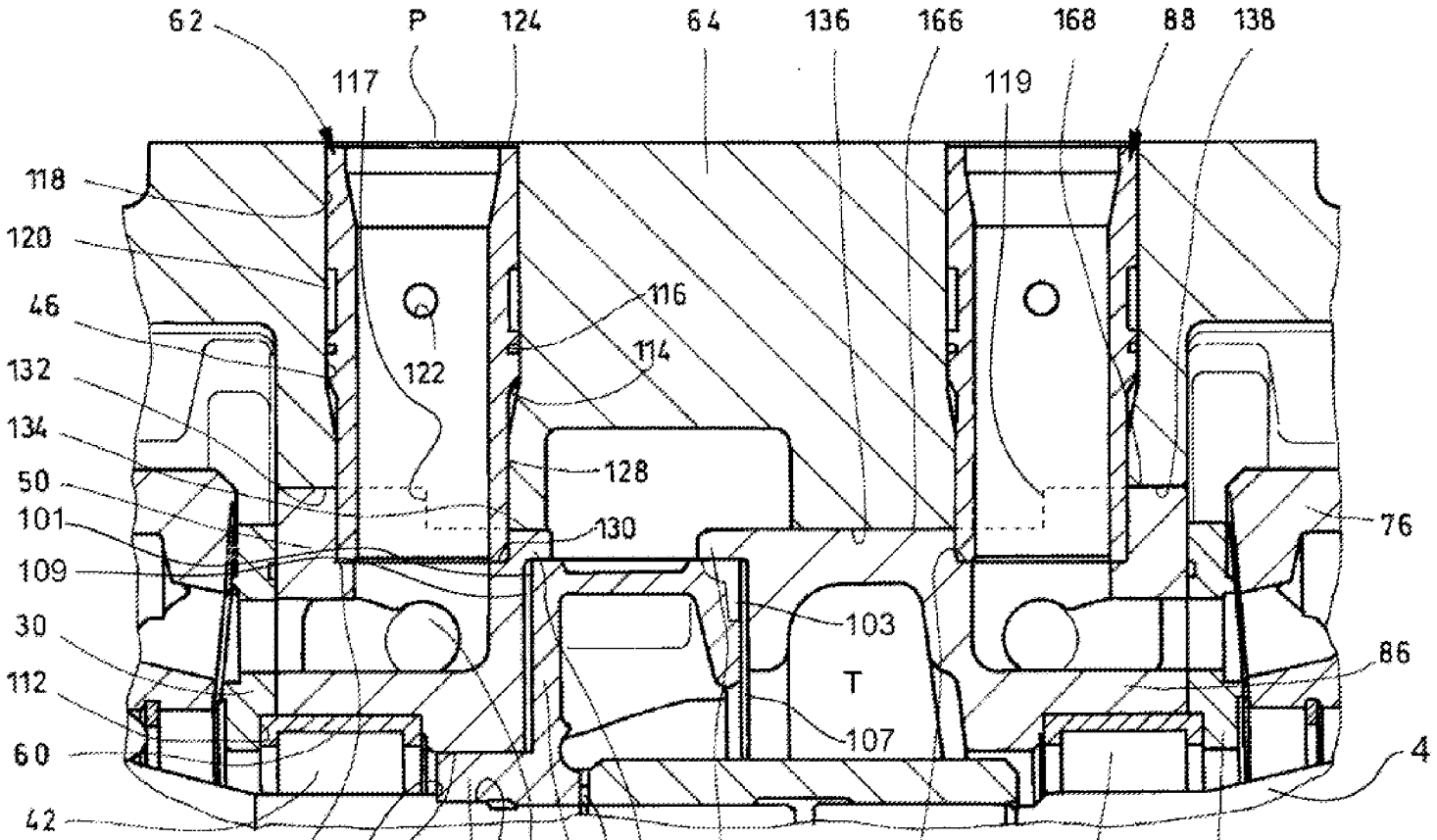
FIG. 4 shows a detail of the axial piston machine according to FIG. 3 with further enlargement.

FIG. 4 shows a further enlarged partial illustration of the central part 64 in the region of the two pressure bushings 62, 88. Part of the impeller wheel 84 with the hub 100, which is connected for conjoint rotation to the drive shaft 4, can be seen. According to this illustration, insert ring 50 has an encircling sealing collar 108 on the end, said collar projecting toward the impeller wheel 84 and partially surrounding the outer circumference of the impeller wheel 84, thus ensuring that the latter is sealed off with a minimum gap in the radial direction. Radial sealing with respect to insert ring 86 is accomplished in a corresponding manner.

As is furthermore illustrated in FIG. 4, there are respective gaps 107, 109 in the axial direction between flat surfaces 101 and 103 of the impeller wheel 84 and the adjacent end face sections of insert rings 50 and 86. The hub 100 projects into a stepped axial bore 110 in insert ring 50, said axial bore widening toward the left (FIG. 4), and, in this region, is guided with a small gap and thus likewise sealed off in the radial direction. As already explained with reference to FIG. 1, this axial bore 110 is widened to form a mounting region 60 for the rolling contact bearing 42. This mounting space 60 is complemented by an end-face recess 112 in the control disk 30 to give a socket for the rolling contact bearing 42, thus providing support for the latter in the axial direction. An outer ring of the rolling contact bearing 42 serves to center the control disk 30. The inner circumferential surface of the hub 100 is supported on one side in the axial direction on a shaft step 111, and is guided in the radial direction by means of a fit 113 on the outer circumference of the drive shaft 4. The axial fixing of the impeller wheel 84 is provided by a retaining ring 115.

To provide axial support for the insert rings 50, 86, supporting shoulders 117, 119, on which corresponding annular faces of the insert rings 50 and 86 rest, are formed on the central part 64.

The construction of the two identical pressure bushings 62, 88 can be found in FIG. 4. According to this, each pressure bushing 62, 88 has an obliquely angled radial shoulder 114, with the result that the end section adjacent to the insert ring has a smaller diameter than the port-side end section of the pressure bushing 62. An annular groove with a sealing ring 116 is formed on the last-mentioned part of the pressure bushing 62, above the radial shoulder 114 (in FIG. 4), said sealing ring resting in a sealing manner on a circumferential wall of the delivery duct 46 into which the pressure bushing 62 is inserted. The end section of the pressure bushing 62 adjacent to the port is set back slightly in the radial direction, giving rise to an annular gap 118 between said circumferential wall of the delivery duct 46 and the outer circumference of the pressure bushing 62. This annular gap 118 ends at a distance from the sealing ring 116 and, in this region, is widened to form an annular groove 120, which is supplied with the pressure at the delivery port P via one or more radial bores 122 in the pressure bushing 62. This pressure thus acts on the larger annular end face 124 of said pressure bushing 62. The smaller annular end face 126, which is at the bottom in FIG. 4, is likewise subjected to the pressure in the delivery duct 46 and in the high-pressure duct section 92. The obliquely angled radial shoulder 114 is subjected to the housing pressure via an annular gap 128 between the outer circumference of the small end section of the pressure bushing 62 and the circumferential wall of the delivery duct 46, said pressure corresponding approximately to the tank pressure and thus being significantly lower than the pressure at the high-pressure port P. Accordingly, the pressure bushing 62 is subjected in a radially inward direction to the high pressure along a differential surface corresponding to the area of the radial shoulder 114, with the result that the pressure bushings 62, 88 are always acted upon in the direction of the associated insert ring 50, 86. That end section of the pressure bushing 62 which is embodied with the annular end face 126 projects into a corresponding radial locating socket 130 in insert ring 50, thus ensuring that the latter is fixed in the circumferential direction. Insert ring 86 is of corresponding design and is thus fixed in position by means of sealing bushing 88. The radial centering of the insert rings 50, 86 is in each case accomplished by means of the stepped circumferential surfaces thereof, which are surrounded by correspondingly stepped centering webs 132, 134 and 136, 138 on the central part 64.

Figure 5:
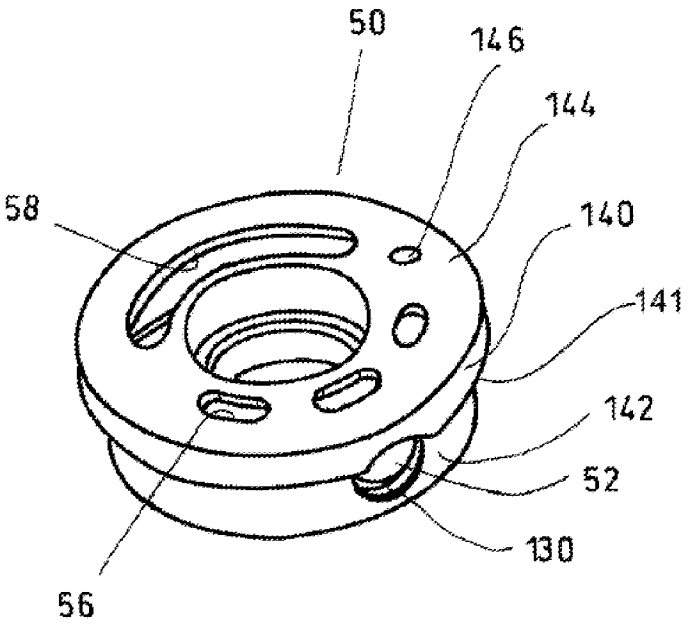
FIGS. 5 and 6 show views of a first insert ring of the dual axial piston machine from FIG. 1.
Figure 6:
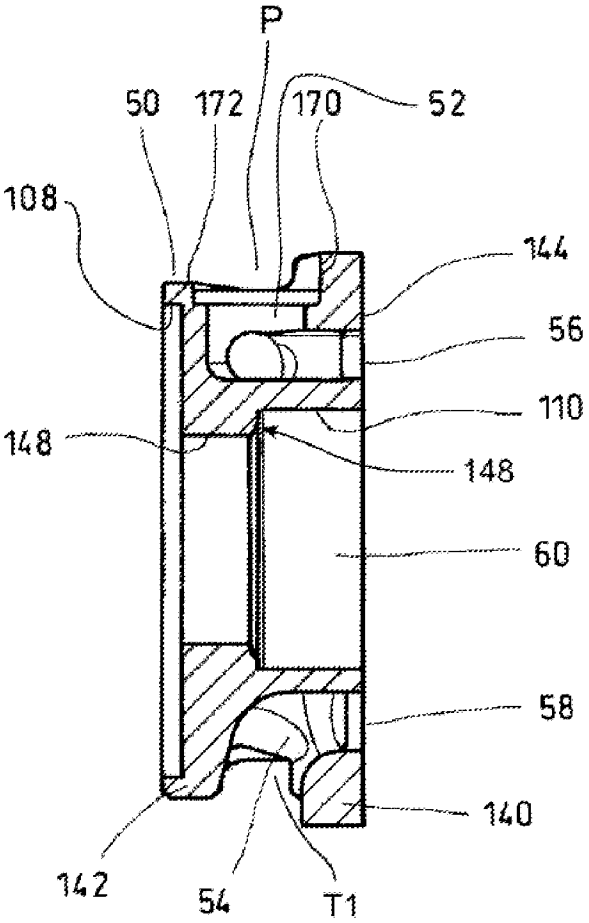

Details of the two insert rings 50 and 86 are explained with reference to FIGS. 5 to 8. FIGS. 5 and 6 show insert ring 50 in a three-dimensional view (FIG. 5) and in a diagonal section (FIG. 6).

The illustration in FIG. 5 shows the stepping of the insert ring 50 of the shoulder 140 on the control-disk side and of an annular section 142, which faces away therefrom, which is set back radially relative to the end section 140 on the control-disk side. A step surface 141 serves to provide axial support on the housing-side supporting shoulder 117 explained with reference to FIG. 4 and absorbs all the forces of the drive mechanism. The locating socket 130 for the pressure bushing 62 is formed in the annular section 142 or across both sections. The end face of the end section 140 on the control-disk side forms a bearing surface 144 for the end face of the control disk 30 facing away from the cylinder barrel 10. In accordance with the geometry of said control disk 30, the low-pressure-side orifice region 58 and the high-pressure-side orifice regions 56 of the high-pressure/low-pressure duct sections 52, 54 formed in the insert ring 50, said regions already having been explained with reference to FIG. 1, are provided in the end section 140 of the insert ring 50. In the specific embodiment, three high-pressure-side orifice regions 56 of approximately kidney-shaped design and a comparatively large, kidney-shaped, low-pressure-side orifice region 58 are thus formed, the geometry of which is designed in accordance with the kidney-shaped intake/delivery openings in the control disk 30. Also opening into the bearing surface 144 is a fixing hole 146, into which a corresponding projection on the control disk 30 projects, thus positioning these two components at the correct angle. As explained above, the axial centering of the control disk 30 is accomplished by means of the outer ring of the rolling contact bearing 42 (see FIG. 4).

The course of the duct sections 52, 54 is very clearly apparent from FIG. 6. According to this, both duct sections 52, 54 are of angular design, with the orifice regions 56, 58 in each case opening in the axial direction into the bearing surface 144 of the end section 140 on the control-disk side. In this embodiment, the duct sections are of angular design since the axial piston pump 1 has lateral P and T ports. In the case of rear ports of an individual pump, the duct sections 52, 54 could accordingly also be of straight-through design.

The orifice regions oriented toward the delivery port P and toward the intake port T respectively open radially into the circumferential wall in the transition zone between the end section 140 on the control side and the annular section 142 set back radially in relation thereto.

As already explained, the axial bore 110 of the insert ring 50 is widened on one side to form a mounting region 60 for the rolling contact bearing 42. The adjoining part of the axial bore 110 (on the left in FIG. 6) is set back radially and forms a shoulder 148 for the axial delimitation of the installation space for the outer ring of the rolling contact bearing 42, the latter being designed as a floating bearing on the drive shaft 4. In the region of the end face of the annular section 142, the sealing collar 108 (already illustrated in FIG. 4) is formed in the case of an impeller design, said collar partially surrounding the impeller 84 in the circumferential direction. As mentioned at the outset, an impeller of this kind can be implemented both in a single pump and in a dual pump. In principle, however, both pump designs can be implemented without an impeller. In the case of an individual pump without a boost pump, the insert ring 50 can also be embodied without the sealing collar 108.

As already mentioned above, the hub 100 of the impeller wheel 84 is embodied with clearance in relation to the insert ring 50 in the radial direction and is thus guided only on the drive shaft 4.

Figure 7:
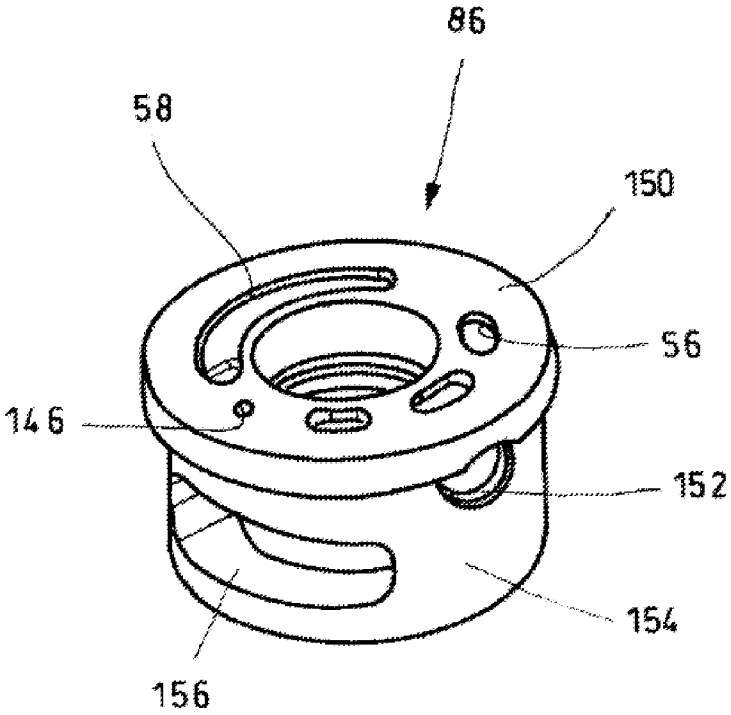
FIGS. 7 and 8 show corresponding views of another insert ring of the dual axial piston machine according to FIG. 2.

FIG. 7 shows the insert ring 86 of the unit 68, said insert ring being of similar construction in principle. This ring accordingly has an end section 150 on the control-disk side, having the three kidney-shaped, delivery-side orifice regions 56, the comparatively large, low-pressure-side orifice region 58 and the fixing hole 146. In the illustration in FIG. 7, it is also possible to see the locating socket 152 for the pressure bushing 88 of the unit 68. Said locating socket 152 opens into the transition zone between the annular section 154 and the end section 150 of the insert ring 86, which is set back in the radial direction. As already explained, the step 163 thereby formed serves to provide axial fixing for the insert ring 86 on the supporting shoulder 119 illustrated in FIG. 4 and thus serves to support the axial forces of the drive mechanism. The step 163 delimits the installation space for the rolling contact bearing 40.

The illustration in FIG. 7 also shows an aperture 156, which opens toward the intake space T, thus allowing the pressure medium to flow to the impeller wheel 84 via said aperture 156.

Figure 8:
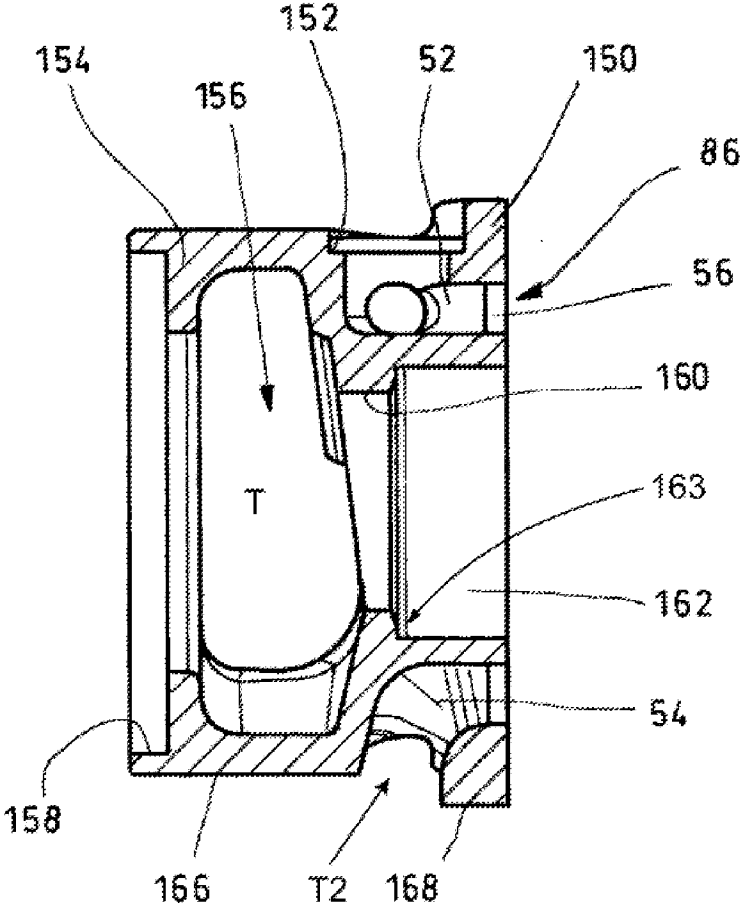

As shown in the section in FIG. 8, an end recess is once again formed in the end face of the annular section 154 on the end adjacent to the impeller wheel, the circumferential walls of said recess forming a sealing collar 158 which surrounds one section of the impeller wheel 84 with a sealing gap, with the result that said wheel separates the boost pressure region from the intake pressure region. An axial bore 160 in the insert ring 86 is widened in the region of the end section 150 on the control-disk side to form a socket 162 for the rolling contact bearing 164 on the right in FIG. 2. The region of the axial bore 160 which adjoins this toward the left is set back radially with respect thereto.

As can be seen in FIG. 4, the two outer circumferential surfaces 166, 168 of the annular section 154 and the end section 150 of the insert ring 86 rest on the associated annular webs 136, 138. In the same way, the insert ring 50 described above is centered by its outer circumferential surfaces 170, 172 by means of the centering webs 132, 134. The supporting shoulders 117, 119 each serve for axial force absorption.

In approximately the same way as in the case of insert ring 50, the high-pressure-side duct section 52 of insert ring 86 is embodied as an angled duct and opens via the kidney-shaped orifice regions 56 into the end face 144 of the end section 150, while the port-side orifice region opens into the circumferential wall of the insert ring 86. The locating socket 152 (already referenced in FIG. 7) for the pressure bushing 88 is also formed in this transition zone (154-150). The low-pressure-side duct section 54 opens into the kidney-shaped orifice region 58 at the end and, on the other hand, opens in the radial direction into the circumferential region of the insert ring 86.

Figure 9:
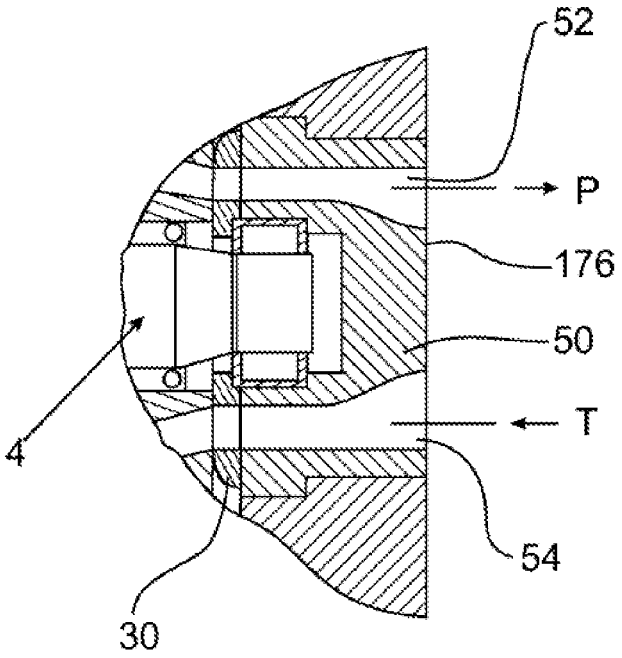
FIG. 9 shows a variant of the embodiment according to FIG. 1.

FIG. 9 shows the cup-bottom region of one variant of the embodiment shown in FIG. 1. In this embodiment, the duct sections 52, 54 are of angular design and open toward the corresponding ports P, T in the circumferential region of the insert ring 50, and therefore the ports P, T on the housing side are likewise arranged in a corresponding manner in the radial direction. In the variant shown in FIG. 9, the low-pressure duct section 54 and the high-pressure duct section 52 run approximately parallel to the axis of the shaft 4, and therefore those end sections of the duct sections 52, 54 that are remote from the control disk 30 open into the end face 176 of the insert ring 50 which is on the right in FIG. 9. Owing to the approximately coaxial routing of the ducts, an insert ring 50 of this kind should be easier to produce than an insert ring with a radial orifice region.

In the embodiments described above, the insert rings 50, 86 and the associated control disks 174 (see FIGS. 2 and 4)

are embodied as separate components. In a variant of the disclosure, the control disks 30, 174 and the associated insert rings 50, 86 can also be of integral design. This development has the advantage that the machining of the contact regions between these two components, which involves a relatively high manufacturing outlay, can be eliminated. This variant has the additional advantage that the machining of the spherical switchover surface, along which the control disk 30, 174 rests against the end face of the respective cylinder barrel 10, 76, which end face is of correspondingly concave design, takes place on a component which is comparatively compact and is therefore more amenable to machining.

A disclosure is made of an axial piston machine having a housing which is optimized in terms of casting, in the bottom of which an insert ring optimized in respect of the pressure loading is formed. A disclosure is also made of an insert ring for an axial piston machine of this kind.

LIST OF REFERENCE SINGS

1 axial piston machine
2 pump housing
4 drive shaft
6 external splines
8 additional external splines
10 cylinder barrel
12 cylinder bore
14 piston
16 working space
18 piston foot
20 sliding shoe
22 swashplate
24 contact surface
26 end wall
27 duct
28 end face
30 control disk
32 kidney-shaped delivery opening
34 kidney-shaped intake opening
36 cover
38 housing
40 rolling contact bearing
42 rolling contact bearing
44 cup bottom
46 delivery duct
48 intake duct
50 insert ring
52 high-pressure duct section
54 low-pressure duct section
56 orifice region
58 orifice region
59 stepped bore
60 mounting region
61 shaft splines
62 pressure bushing
63 socket
64 central part
65 closure cap
66 unit
68 unit
70 housing wall
72 housing wall
74 cover
76 cylinder barrel
78 drive shaft
80 coupling bush
82 boost pump
84 impeller wheel
86 insert ring
88 pressure bushing
90 delivery duct
92 high-pressure duct section
94 control disk
96 kidney-shaped delivery opening
98 kidney-shaped intake opening
100 hub
101 flat surface
102 external splines
103 flat surface
104 boost pressure space
105 low-pressure duct section
106 external splines
107 gap
108 sealing collar
109 gap
110 axial bore
111 shaft step
112 end-face recess
113 fit
114 radial shoulder
115 retaining ring
116 sealing ring
117 supporting shoulder
118 annular gap
119 supporting shoulder
120 annular groove
122 radial bore
124 annular end face
126 annular end face
128 gap
130 locating socket
132 centering web
134 centering web
136 centering web
138 centering web
140 shoulder on the control-disk side
141 step surface
142 annular section
144 bearing surface
146 fixing hole
148 shoulder
150 end section on the control-disk side
152 locating socket
154 annular section
156 aperture
158 sealing collar
160 axial bore
162 socket
163 step
164 rolling contact bearing
166 outer circumferential surface
168 outer circumferential surface
170 outer circumferential surface
172 outer circumferential surface
174 control disk
176 end face

The invention claimed is:

1. A dual axial piston machine, comprising:

a pump housing that includes a central part and that defines a double-cup shape;

a first cylinder barrel and a second cylinder barrel mounted in the pump housing and having a multiplicity of pistons, each delimiting a working space and being supported on an adjustable swashplate;

a first control disk arranged at a first side of the central part of the pump housing and configured to alternately connect the working space of the first cylinder barrel to a first low-pressure and a first high-pressure duct;

a second control disk arranged at a second side of the central part of the pump housing and configured to alternatingly connect the working space of the second cylinder barrel to a second low-pressure and second high-pressure duct;

a drive shaft configured to connect to the first cylinder barrel and second cylinder barrel to rotate conjointly; and a first insert ring, on which the drive shaft is mounted and in which a first high-pressure duct section is formed, the first insert ring inserted into the first side of the central part of the pump housing, wherein the first high-pressure duct section defines a first orifice region that is on a side of the first insert ring facing towards the first control-disk, and that extends in an at least substantially axial direction with respect to the drive shaft, and a second orifice region that is on a side of the first insert ring facing the first high-pressure duct, and that extends in an at least substantially radial direction with respect to the drive shaft; and a second insert ring, on which the drive shaft is mounted and in which a second high-pressure duct section is formed, the second insert ring inserted into the second side of the central part of the pump housing, wherein the second high-pressure duct section defines a third orifice region that is on a side of the second insert ring facing towards the second control-disk, and that extends in an at least substantially axial direction with respect to the drive shaft, and a fourth orifice region that is on a side of the second insert ring facing the second high-pressure duct, and that extends in an at least substantially radial direction with respect to the drive shaft;

wherein the first and second insert rings are configured to absorb an amount of pressure that corresponds to pressure loading of the axial piston machine.

2. The dual axial piston machine as claimed in claim 1, wherein the first and second sides of the central part each define a respective socket configured to receive the first and second insert ring respectively, and having a diameter which is larger than a diameter of the drive shaft.

3. The dual axial piston machine as claimed in claim 1, wherein the first and second insert rings are formed by one of nitrided steel casting, heat-treated spheroidal graphite iron casting, forging, and production from a solid part by machining.

4. The dual axial piston machine as claimed in claim 1, the first insert ring further including a first low-pressure duct section having at least one fifth orifice region on a side of the first insert ring that is facing the first low pressure duct section, and that extends at least substantially in the radial or axial direction with respect to the drive shaft; and the second insert ring further including a second low-pressure duct section having at least one sixth orifice region on a side of the second insert ring that is facing the second low pressure duct section, and that extends at least substantially in the radial or axial direction with respect to the drive shaft.

5. The dual axial piston machine as claimed in claim 1, wherein:

the first control disk and the first insert ring are integrally formed; and the second control disk and the second insert ring are integrally formed.

6. The dual axial piston machine as claimed in claim 1, wherein each of the first insert ring and the second insert ring has a socket for a shaft bearing.

7. The dual axial piston machine as claimed in claim 1, further comprising a boost pump configured to subject a pressure medium flowing in on a low-pressure side to a boost pressure.

8. The dual axial piston machine as claimed in claim 7, further comprising an impeller wheel guided on the drive shaft.

9. The dual axial piston machine as claimed in claim 7, wherein the boost pump includes an impeller wheel configured to form a sealing gap, in at least one section, with at least one of the first insert ring and the second insert ring.

10. The dual axial piston machine as claimed in claim 1, wherein the drive shaft has two drive shafts connected to one another by a coupling bush.

11. The dual axial piston machine as claimed in claim 1, wherein a pressure resistance of the first insert ring and second insert ring is increased by heat treatment.

12. The dual axial piston machine as claimed in claim 1, wherein:

the second orifice region in the first insert ring and the fourth orifice region in the second insert ring each define a locating socket; and a pressure bushing is received in each locating socket, each pressure bushing having a stepped shape which defines a radial shoulder that is oblique with respect to the drive shaft and that is configured to be acted on by a housing pressure of the pump housing which is less than a pressure of the first or second high pressure duct sections such that a resultant of pressure force acting on the pressure bushing acts in a substantially inward radial direction with respect to the drive shaft.

13. The dual axial piston machine as claimed in claim 12, wherein each one of the pressure bushings forms a position securing mechanism for each one of the first and second insert rings.

* * * * *